US006173453B1

(12) United States Patent
Shahar

(10) Patent No.: US 6,173,453 B1
(45) Date of Patent: Jan. 16, 2001

(54) TOILET VENTING SYSTEM

(76) Inventor: Yehezkel Shahar, 36 Fabrigat Street, Ramat Gan 52322 (IL)

( * ) Notice: Under 35 U.S.C. 154(b), the term of this patent shall be extended for 0 days.

(21) Appl. No.: 09/236,634

(22) Filed: Jan. 26, 1999

(51) Int. Cl.[7] ..... E03D 9/052
(52) U.S. Cl. ..... 4/213; 4/216
(58) Field of Search ..... 4/213, 216, 348, 4/349, 350

(56) References Cited

U.S. PATENT DOCUMENTS

| | | | | |
|---|---|---|---|---|
| 2,047,067 | * | 7/1936 | Harris | 4/216 X |
| 4,222,129 | * | 9/1980 | Baker | 4/213 |
| 4,620,329 | | 11/1986 | Wix | 4/213 X |
| 4,800,596 | * | 1/1989 | Menge | 4/348 |
| 5,179,738 | * | 1/1993 | Sowards | 4/213 |
| 5,361,422 | * | 11/1994 | Vincent et al. | 4/213 |
| 5,715,543 | * | 2/1998 | Sim | 4/213 |

FOREIGN PATENT DOCUMENTS

| | | |
|---|---|---|
| 1902751 | 9/1969 | (DE) . |
| 1658269 | 6/1970 | (DE) . |
| 2058925 | 6/1972 | (DE) . |
| 2943641 | 5/1980 | (DE) . |
| 3020032 | 2/1984 | (DE) . |
| 3439587 | 4/1986 | (DE) . |
| 4416420 | 11/1995 | (DE) . |

* cited by examiner

*Primary Examiner*—Robert M. Fetsuga
(74) *Attorney, Agent, or Firm*—Browdy and Neimark

(57) ABSTRACT

A system for venting a toilet comprising a toilet bowl fitted with a discharge outlet at a lower portion of the toilet bowl connected to a sewer line and an inlet for flushing water, connected to a water cistern via a flushing tube and an exhaust line connected at a first end to the sewer line and its second end being in a flow communication with the toilet bowl via the flushing tube. The exhaust line is fitted with an electrically operated exhaust fan adapted to generate flow in direction towards the sewer line, and a valve member located intermediate the exhaust fan and the flushing tube. The valve member prevents flow in direction from the sewer line and further preventing water flow in direction from the flushing tube towards the exhaust fan. Switching apparatus is provided for activating the exhaust fan to excite gas flow from the toilet bowl towards the sewer line.

6 Claims, 5 Drawing Sheets

TOILET VENTING SYSTEM

FIELD OF THE INVENTION

The present invention is in the field of venting odors from toilets and more specifically it is concerned with a venting system for toilets of the type comprising a toilet bowl with a water cistern connected thereto for flushing the toilet bowl.

BACKGROUND OF THE INVENTION

Various attempts have been made to provide means for ventilating odors which are typically associated with toilets. One problem concerning systems for venting toilets is that they are typically connected to the sewer system and must thus be fitted with suitable gas traps, so as to prevent flow of odors in a direction from the sewer system into the toilet room.

A common attempt to solve the problem of ventilating toilets is by using one or more conventional air blowers to remove air from the toilet room outside. However, a disadvantage of this system is that odors evacuated from the toilet room are spread into surrounding and neighboring rooms. Furthermore, such venting systems require expensive installation, since a passageway must be made in a wall section of the toilet room. Furthermore, such venting means are at times displeasing to the eye, and it is difficult to conceal them.

Other types of toilet ventilating systems are those which comprise an air intake port at or adjacent to the toilet bowl and which are fitted with an electrically operated exhaust fan. However, such systems are usually expensive and require complicated electrical and plumbing preparations and, even more so, in some cases, require a specially designed toilet bowl, which obviously prevents installing of such systems in already existing toilet bowls.

Other arrangements for venting toilets involve a considerable number of components requiring making fittings which are unsightly and tend, throughout usage, not to always mate properly. Since such systems are often unsightly, it is thus usually a requirement to conceal or hide such ventilating systems and this is typically carried out by inserting most of the components of the venting system within the wall. However, at least some piping components remain exposed. This arrangement, apart from being unsightly, also involves the drawback that those components hidden within the wall or a cabinet are not easily approached for service.

It is the object of the present invention to provide a new and improved toilet venting system, in which the above referred to disadvantages are overcome or essentially reduced.

SUMMARY OF THE INVENTION

According to the present invention there is system for venting a toilet comprising a toilet bowl fitted with a discharge outlet at a lower portion of the toilet bowl connected to a sewer line and an inlet for flushing water, connected to a water cistern via a flushing tube; an exhaust line connected at a first end to the sewer line and its second end being in a flow communication with the toilet bowl; said exhaust line being fitted with an electrically operated exhaust fan adapted to generate flow in direction towards the sewer line, and a valve member preventing flow in direction from said sewer line; and switching means for activating said exhaust fan to excite gas flow from the toilet bowl towards the sewer line.

According to a first preferred embodiment of the invention, the second end of exhaust line is connected to the flushing tube and the valve member is located intermediate the exhaust fan and said flushing tube and further prevents water flow in direction from said flushing tube towards said exhaust fan.

Preferably, one end of the exhaust line is connected to the toilet bowl adjacent a top end thereof. Still preferably, said second end is connected to one or more openings at a circular lip portion of the toilet bowl.

By another application, said second end is connected to one or more openings formed in a toilet seat articulated with said toilet bowl.

According to a specific application the system further comprises a differential pressure switch having an intake tube connected downstream said flushing tube and adapted to cease operation of the exhaust fan upon flushing the toilet.

By another application, the exhaust tube is connected within the water system and above the maximal water level. This arrangement is both pleasing to the eye and allows the use of a one way valve only.

A specific design of the system according to the invention is adapted for use with monoblock-type toilets, wherein the exhaust tube is incorporated with an exhaust block fitted at a bottom of the water cistern.

According to a first embodiment, the valve member for use with a toilet system according to the invention comprises a housing formed with an inlet gate and an outlet gate positioned above said inlet gate, and a spheric buoy valve member displaceable between a first position, in which it sealingly rests over the inlet gate and prevents gas flow in the direction from the sewer line; a second position in which it is floatingly urged by water to sealingly engage said outlet gate, so as to prevent water flow in the direction towards said sewer line; and an intermediate position during operation of the exhaust fan in which the spheric valve member is disengaged from either gate, thus allowing only gas flow in the direction towards the sewer line.

According to a second embodiment, the valve member comprises a housing formed with a first inlet gate and a second gate positioned above said first inlet gate; a top face of said second gate serving as a second inlet gate and a bottom face thereof serving as an outlet gate; a first spheric buoy valve member displaceably retained within the housing and a second spheric valve member sealingly engageable with said second inlet gate; the arrangement being such that in rest both spheric valve members sealingly engage the first and second inlet gate, respectively, thus preventing flow in direction from the sewer line, while in operation of the exhaust fan both spheric valve members disengage from the inlet gates, allowing only gas flow in the direction towards the sewer line and upon entry of water into the housing, said first spheric valve member sealingly engages said outlet gate, thus preventing water flow in direction towards said exhaust fan.

According to any of the embodiments of the present invention, at least the exhaust tube and the valve member are accommodated within the water system.

The switching means for activating the exhaust fan may be triggered by pressure of a person sitting on a toilet seat of the toilet bowl, or by an infra-red sensor, sensing a person in proximity to said toilet.

BRIEF DESCRIPTION OF THE DRAWINGS

For better understanding, the invention will now be described by way of example only, with reference to the annexed Figures, in which.

DETAILED DESCRIPTION OF SPECIFIC EMBODIMENTS

Figure 1:
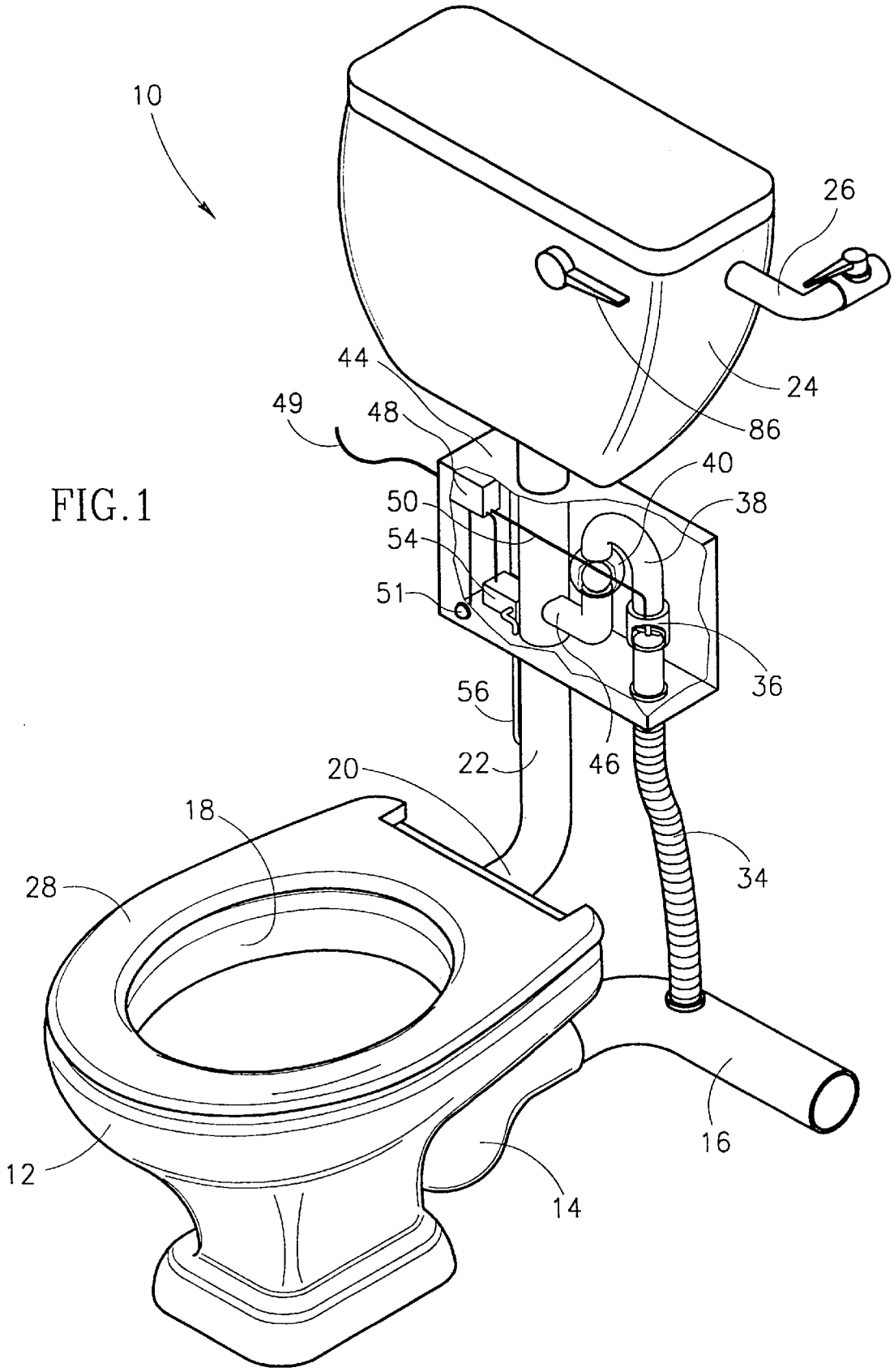
FIG. 1 is a perspective view of a toilet venting system, in accordance with a first embodiment of the present invention.

Attention is first directed to FIG. 1, in which a toilet system generally designated 10 comprises a conventional toilet bowl 12 formed with a discharge opening 14 at a lower portion thereof and connected to a sewer line 16, connected in turn to the main sewer line (not shown) as known, per se. The toilet bowl 12 is fitted at its top end with an inward circular lip 18, defining a water flushing path connected to a flushing water inlet 20, which is in turn connected via a flushing tube 22 to a water cistern 24 fitted with a water supply line 26, as known in the art.

The toilet bowl 12 is also fitted with a hinged toilet seat 28 and a toilet cover which for sake of clarity has been removed.

The system further comprises a flexible exhaust tube 34 connected at its lower end to the sewer line 16 and at an upper end thereof to an electrically operated exhaust fan 36 accommodated within casing 44. An inverted U-like tube portion 38 intermediately connects between the exhaust fan 36 and a valve member 40, which in turn is connected via tube portion 46 to the flushing tube 22. Further received within the casing 44 is an electronic control unit 48 fitted with electric supply line 49 and electrically connected by suitable electrical wiring 50 to the exhaust fan 36 and to an infra-red sensor 51 adapted for sensing the presence of a person adjacent to the toilet. A differential pressure switch 54 is also connected to the control 48 and has an intake tube 56 connected to the flushing tube 22 at a bottom end thereof. The specific operation of the different components will become apparent hereinafter.

Figure 2A:
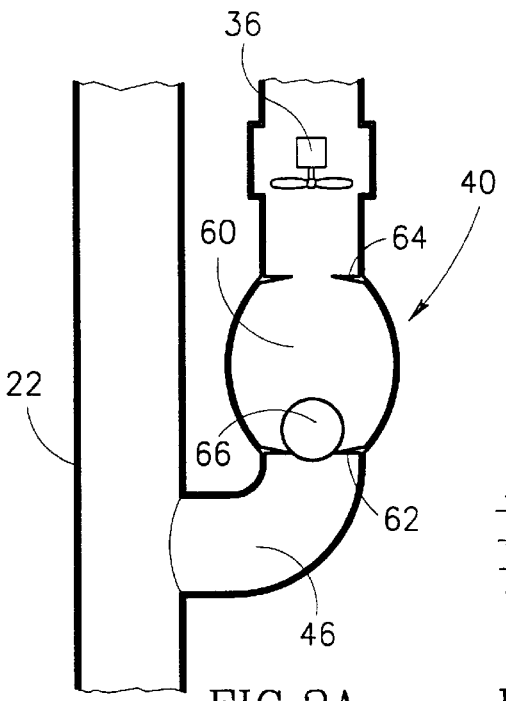
FIGS. 2A–2C illustrate three operative positions of a valve member for use in conjunction with the toilet venting system of the present invention.
Figure 2B:
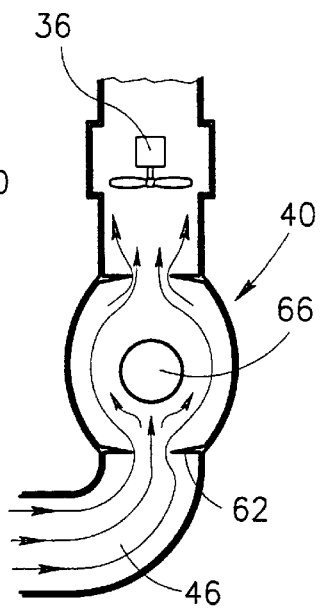
Figure 2C:
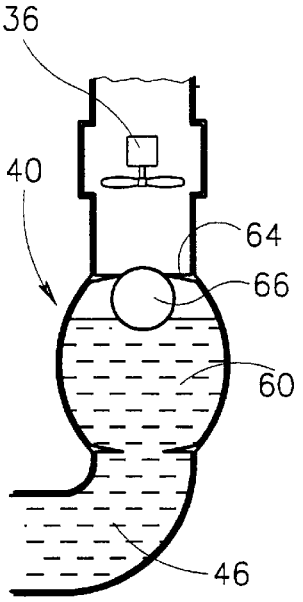

Further attention is now directed to FIGS. 2A–2C for understanding the construction and operation of valve member 40 in accordance with a first application. The valve member 40 comprises a housing 60 fitted with an inlet gate 62 and an outlet gate 64, with a spheric buoy member 66 displaceable within the housing, depending on the operative position of the system. In FIG. 2A the spheric member is in rest and it engages the inlet gate 62, thus preventing gas flow in direction from the sewer line (not seen) towards the flushing tube 22 and into the toilet bowl, so as to prevent unpleasant odors to enter the toilet bowl. In the position seen in FIG. 2B exhaust fan 36 is activated, whereby the spheric valve member 66, which is typically made of a light plastic material, is elevated from the inlet gate 62 allowing exhaust gas flow in a direction from the flushing tube 22 towards the flexible exhaust tube 34 and into the sewer line 16 (not seen), whereby odors are exhausted from the toilet bowl. Upon flushing the toilet, water flowing through the flushing tube 22 will tend to rise through tube portion 46 into the housing 60. In this position the spheric buoy member 66 will be urged by the water to sealing engagement with the outlet gate 64, as can be seen in FIG. 2C. In this position, water is prevented from reaching the exhaust fan 36.

Figure 3A:
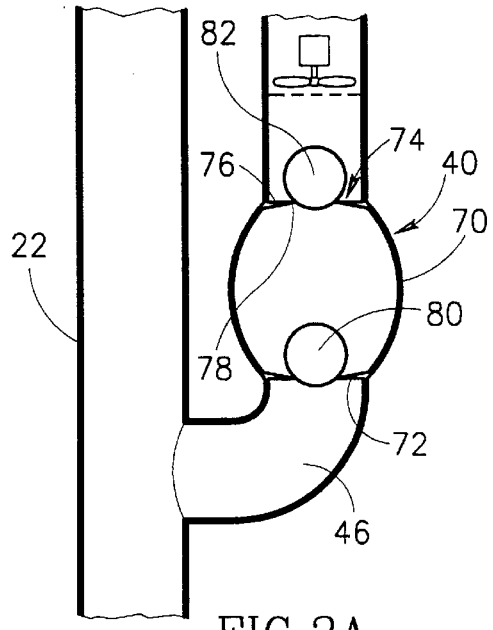
FIGS. 3A–3C represent three operative positions of another type of valve member, suitable for use in conjunction with the toilet venting system, in accordance with the present invention.
Figure 3B:
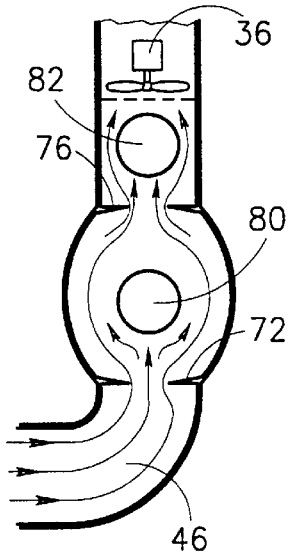
Figure 3C:
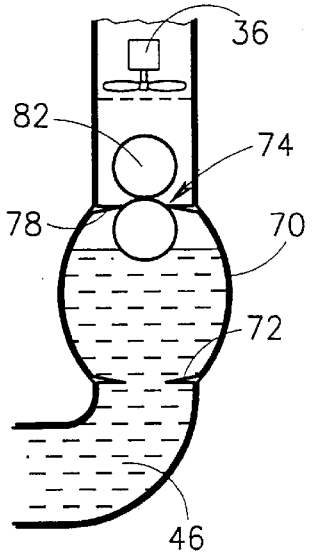

FIGS. 3A–3C illustrate three operative positions of another valve member 40, wherein the housing 70 is fitted with a first inlet gate 72, a second gate 74 with its upper face serving as a second inlet gate 76 and its bottom face 78 serving as an outlet gate. A first spheric buoy member 80 is accommodated within the housing 70 and is adapted for sealing engagement with either the first inlet gate 72 or with the outlet gate 78. A second spheric valve member 82 is adapted for sealing engagement with the second inlet gate 76. In the position seen in FIG. 3A the system is at rest, with both spheric members 80 and 82 sealingly engaging the first and second inlet gates 72 and 76, respectively. In this position gas is prevented from flowing in direction from the sewer line (not seen) towards the toilet bowl, thus preventing unpleasant odors from entering from the sewer line. In the position seen in FIG. 3B the fan 36 is activated entailing air flow in direction towards the sewer line and consequential disengagement of the spheric valve members 80 and 82 from the first inlet gate 72 and from the second inlet gate 76, respectively, thus permitting gas flow in direction from the flushing cube 22 towards the sewer line (not seen), exhausting odors from the toilet bowl. However, upon flushing the toilet, when water enters the housing 74, the first spheric buoy member 80 is urged by the rising water within the housing 70 into a position in which it sealingly engages the outlet gate 78, thus preventing water flow towards the exhaust fan 36.

Referring back to FIG. 1, it will now be explained how the ventilating system, in accordance with the first embodiment of the present invention operates. At rest the valve member 40 prevents odors from entering from the sewer line, as explained in connection with FIGS. 2A and 3A. Upon approach of a person into proximity with the toilet, the infra-red sensor 51 generates a signal to the electric control unit 48, the latter activating the electric exhaust fan 36, whereby gases are exhausted from the toilet bowl 12 via openings at the lip portion 18 of the toilet bowl 12, than flushing tube 22 and through tube portion 46, via the valve member 40, as in the position illustrated in FIGS. 2B or 3B, and through the flexible exhaust tube 34 down to the sewer line 16.

When the toilet is flushed by operating handle 86 of cistern 24, water flows downwards towards the bowl 12 via flushing tube 22, whereby differential pressure switch 54 senses rise of pressure within pressure tube 56 and a control signal is transmitted to control unit 48, which in turn ceases operation of exhaust fan 36. Simultaneously, water entering the tube portion 46 and entering the valve member 40 will be prevented from further flow towards the electric exhaust van 36, as explained hereinabove, in connection with FIGS. 2C and 3C. Then, after the person has departed from the toilet room, the ventilating system may continue its operation for several more minutes, depending on predetermined programming of the control unit 48 (e.g., by a relay switch).

Figure 4:
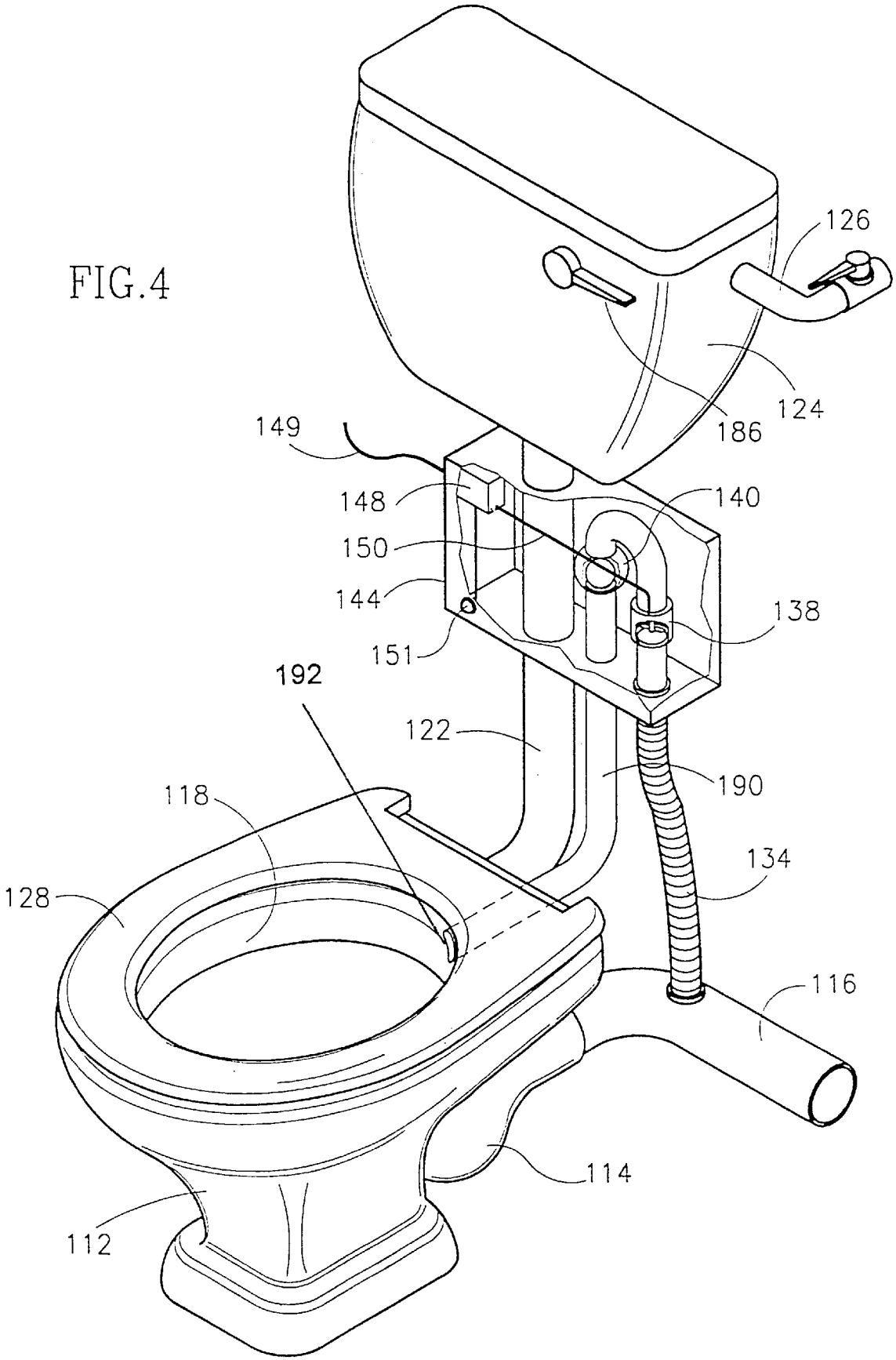
FIG. 4 is an isometric view of a toilet venting system, in accordance with a second embodiment of the present invention.

Reference is now made to FIG. 4 of the drawings illustrating a second embodiment of the present invention wherein, for the sake of clarity, those elements which are essentially similar to the elements described with reference to FIG. 1 are designated by the same reference number with a shift of 100. As seen in FIG. 4, exhaust tube 134 is connected at a bottom end to the sewer line 116 and is in flow communication with a suction tube portion 190 terminating at an upper portion of the toilet bowl 112 with an opening 192 positioned behind lip 118. Intermediate the suction tube 190 and the exhaust tube 134 there is provided the valve member 140 and the electric exhaust van 138 with the appropriate control means as explained hereinbefore with reference to FIG. 1.

Operation of the embodiment seen in FIG. 4 is similar to that explained with reference to FIG. 1, except that the unpleasant odors are exhausted via tube 190 rather than via the flushing tube 122. This arrangement eliminates the provision of differential pressure switch arrangement and also permits that valve member 140 will merely be a one-way valve, so as to prevent gas flow in direction from the sewer line 116 towards the toilet bowl 112, that, since there is no fear of flushing water flowing upstream via the tube 190 towards the electric exhaust fan 138.

Figure 5:
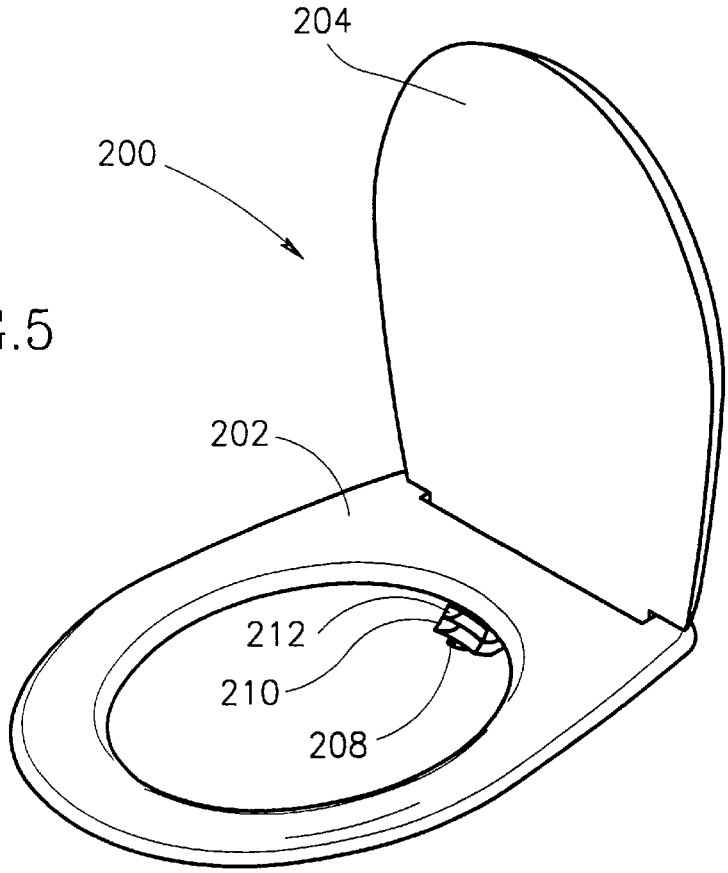
FIG. 5 is an isometric view of a toilet seat for use in conjunction with a toilet venting system, in accordance with the second embodiment of the present invention.

Further attention is now directed to FIG. 5 illustrating a toilet seat of the type which serves also as a bidet. The toilet seat assembly generally designated 200 comprises a toilet seat 202 and a lid 204 both being pivotally connected to a toilet bowl as known, per se (not shown). The toilet seat 202 is integrally fitted with a nozzle 208 connected to a water supply (not shown) and a warm air outlet 210 for blowing warm drying air. The toilet seat is further fitted with an odor intake opening 212 which will typically be connected to an end of the exhaust tube 190, as seen, for example, in FIG. 4. Obviously, in such an application, there should be provided a flexible tube portion connecting between the exhaust tube 190 and the intake opening 212.

Figure 6:
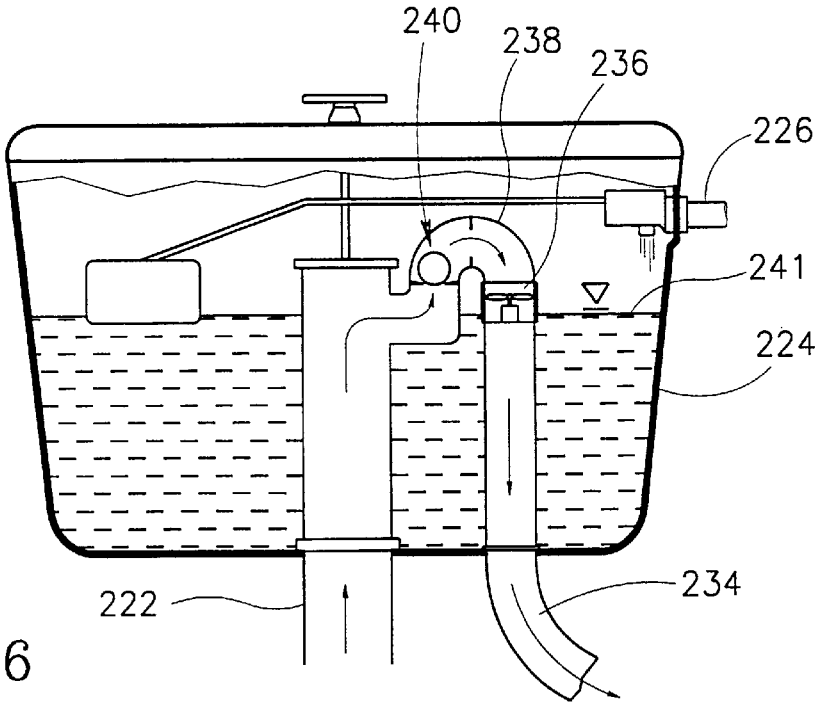
FIG. 6 is a cross-section through a water system, for use in connection with an application of the invention, in accordance with the first embodiment of the present invention.

FIG. 6 illustrates an application of the embodiment seen in FIG. 1, wherein cistern 224 is integrally fitted with a portion of the exhaust tube 234 having a highermost inverted U-like tube portion 238, extending within the cistern 224 above maximum water level 241. Tube portion 238 is connected to a top end of flushing tube 222 via a valve member 240, which in this case is a simple one-way valve, preventing odor carrying gas to flow in direction from the sewer line (not seen) to the flushing tube 222 and into the toilet. An electric exhaust fan 236 is fitted on the exhaust tube 234 (the exhaust fan may also be fitted downstream on said exhaust tube). Operation of this application is similar to that explained hereinabove in connection with FIG. 1.

Figure 7A:
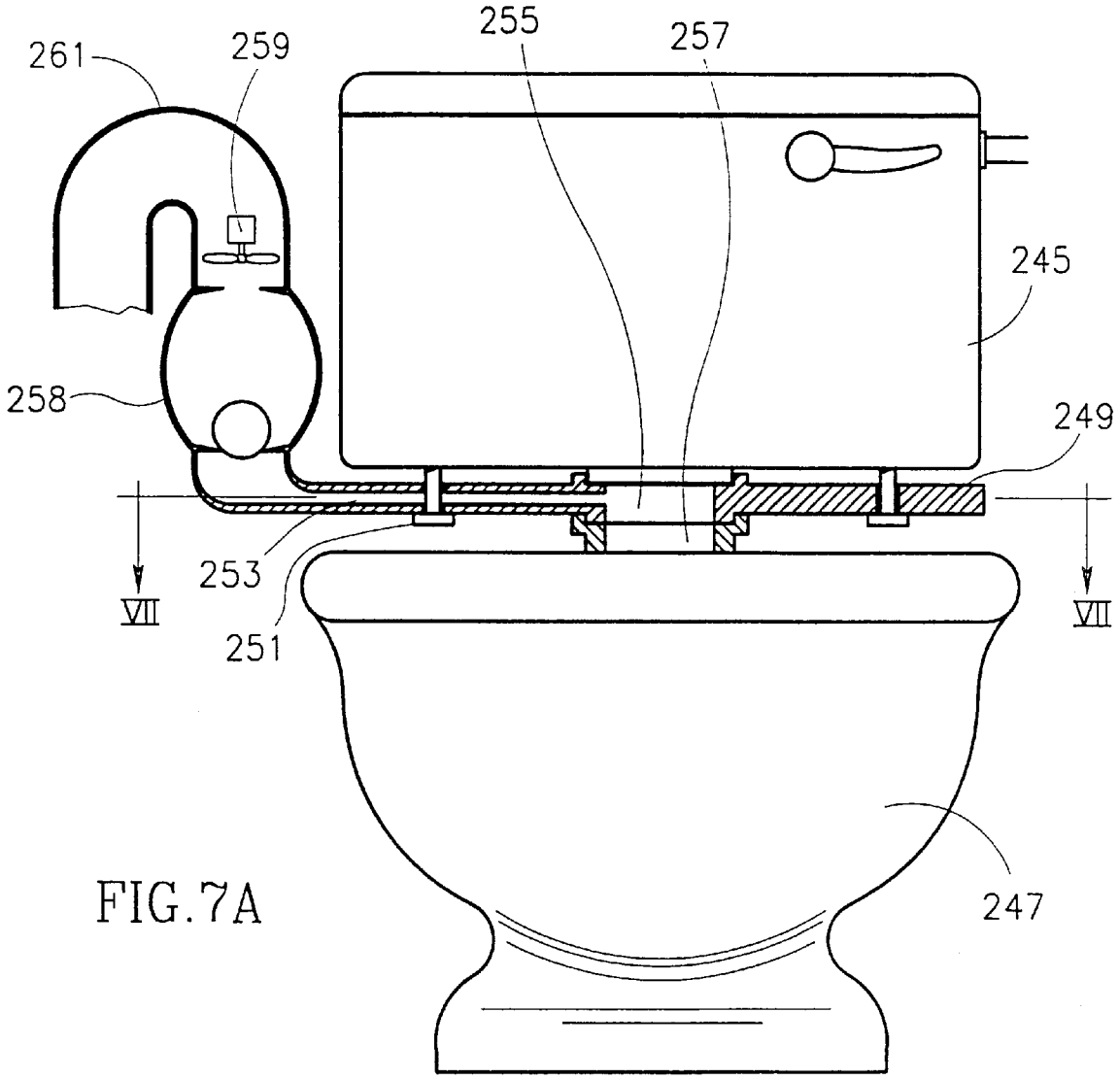
FIG. 7A is a front view, partially sectioned of an application in accordance with the first embodiment of the present invention, used with a monoblock type toilet.

FIG. 7A illustrates a monoblock-type toilet in which the cistern 245 is mounted at a rear top portion of the toilet bowl 247 with a block member 249 mounted beneath the cistern 245 and in fact being attached thereto by bolts 251. Block 249 comprises an exhaust tube portion 253 connected via opening 255 to flushing tube 257. Exhaust tube 253 is connected at its opposed end to a valve member 258 of the type illustrated, for example, in FIG. 2 and fitted with an electric exhaust fan 259. Tube portion 261 is then connected to a sewer line (not shown).

Figure 7B:
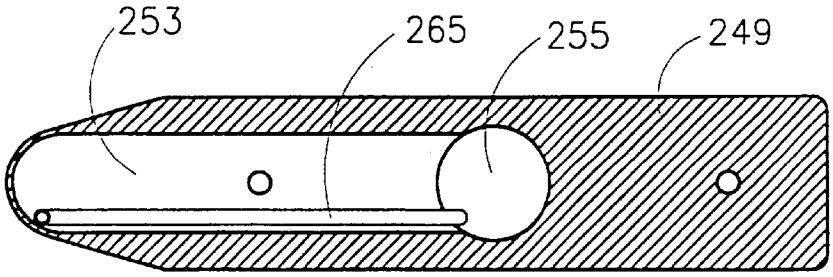
FIG. 7B is a cross-section through line VII—VII in FIG. 7A.

As can be seen in FIG. 7B which is a cross-section taken along the line VII—VII in FIG. 7A, the block 249 has a pressure intake tube 265 extending within the exhaust tube 253 and connected in turn to a differential pressure switch (not shown), the function and operation of which have been explained in connection with FIG. 1. Other control components, e.g. operating switch etc. are not shown, but as no doubt will be appreciated by the artisan, are provided and operate in a similar manner as illustrated and explained hereinbefore with reference to the previous embodiments.

Operation of the toilet flushing system in accordance with the application of FIG. 7A is similar to that explained with reference to FIG. 1, wherein valve member 258 allows odor carrying gas flow in direction from the toilet bowl 247 towards the sewer line (not shown), but prevents water flow in that direction. In operation, upon activating of the exhaust fan 259 gases are exhausted via the flushing tube 257 through opening 255 and exhaust tube 253 towards the sewer line. However, when water is flushed, the valve member 258 will prevent water from reaching the exhaust fan 259, as explained hereinabove with reference to FIG. 2C and the differential pressure switch (not shown) will cease operation of the electric exhaust fan 259.

It will be appreciated by a person versed in the art that other valve means may be provided which have the same functional features, as explained hereinabove with reference to FIGS. 2 and 3. It will also be appreciated that various electronic control means may be provided, e.g. other types of sensing means, timer means etc., for activating and ceasing operation of the system, mutatis mutandis.

What is claimed is:

1. A system for venting a toilet comprising a toilet bowl fitted with a discharge outlet at a lower portion of the toilet bowl connected to a sewer line and an inlet for flushing water, connected to a water cistern via a flushing tube;

the system characterized in that it further comprises an exhaust line connected at a first end to the sewer line and its second end being in a flow communication with the toilet bowl via the flushing tube; said exhaust line being fitted with an electrically operated exhaust fan adapted to generate flow in a direction towards the sewer line, and a valve member located intermediate the exhaust fan and said flushing tube, said valve member preventing flow in a direction from said sewer line and further preventing water flow in a direction from said flushing tube towards said exhaust fan and wherein said valve member comprises a housing formed with a first inlet gate and a second gate positioned above said first inlet gate; a top face of said second gate serving as a second inlet gate and a bottom face thereof serving as an outlet gate; a first spheric buoy valve member displaceably retained between the first inlet gate and the second gate, and a second spheric valve member sealingly engageable with said second inlet gate; and sensing means for activating said exhaust fan to excite gas flow from the toilet bowl towards the sewer line.

2. A system for venting a toilet according to claim 1, further comprising a differential pressure switch having an intake tube connected downstream on said flushing tube and adapted to cease operation of the exhaust fan upon flushing the toilet.

3. A system for venting a toilet according to claim 1, wherein said exhaust tube is connected within the water cistern and above a maximal water level in the water cistern.

4. A system for venting a toilet according to claim 1, wherein at least the exhaust tube and the valve member are accommodated within the water cistern.

5. A system for venting a toilet according to claim 1, wherein the switching means is triggered by an infra-red sensor, sensing a person in proximity to said toilet.

6. A system for venting a toilet according to claim 1, wherein when the exhaust fan is at rest, at least the second spheric valve member sealingly engages the second inlet gate, thus preventing flow in direction from the sewer line, while during operation of the exhaust fan the second spheric member disengage from the second inlet gate, allowing only gas flow in the direction towards the sewer line and upon entry of water into the housing, said first valve member sealingly engages said outlet gate, thus preventing water flow in direction towards said exhaust fan.

* * * * *